US011420436B2

(12) United States Patent
Bazin et al.

(10) Patent No.: US 11,420,436 B2
(45) Date of Patent: Aug. 23, 2022

(54) DEVICE FOR ATTACHING A DOCTOR BLADE ON A DOCTOR BLADE CHAMBER AND DOCTOR BLADE CHAMBER THUS EQUIPPED

(71) Applicant: Bobst Lyon, Villeurbanne (FR)

(72) Inventors: Rene Bazin, Farnay (FR); Philippe Fleury, Saint Jean des Vignes (FR); Julien Mattrand, Decines-Charpieu (FR)

(73) Assignee: Bobst Lyon, Bron (FR)

( * ) Notice: Subject to any disclaimer, the term of this patent is extended or adjusted under 35 U.S.C. 154(b) by 0 days.

(21) Appl. No.: 17/045,743

(22) PCT Filed: Apr. 26, 2019

(86) PCT No.: PCT/EP2019/025130
§ 371 (c)(1),
(2) Date: Oct. 6, 2020

(87) PCT Pub. No.: WO2019/211005
PCT Pub. Date: Nov. 7, 2019

(65) Prior Publication Data

US 2021/0031506 A1 Feb. 4, 2021

(30) Foreign Application Priority Data

Apr. 30, 2018 (FR) ..... 18/00384

(51) Int. Cl.
*B41F 31/02* (2006.01)
*B41F 31/04* (2006.01)

(52) U.S. Cl.
CPC ..... *B41F 31/027* (2013.01); *B41F 31/04* (2013.01)

(58) Field of Classification Search
CPC ..... B41F 31/04; B41F 31/027; B41F 9/1036; B41F 9/10; B05C 11/044
See application file for complete search history.

(56) References Cited

U.S. PATENT DOCUMENTS 4,453,463 A 6/1984 Dahlgren et al.
6,637,330 B1 10/2003 Nordby et al.
(Continued)

FOREIGN PATENT DOCUMENTS

CN 107614266 A 1/2018
JP 2003-502192 A 1/2003
(Continued)

OTHER PUBLICATIONS

International Search Report dated Jun. 3, 2019, in counterpart International Patent Application No. PCT/EP2019/025130 (4 pages, in English).

*Primary Examiner* — Manish S Shah
*Assistant Examiner* — Leo T Hinze
(74) *Attorney, Agent, or Firm* — Bookoff McAndrews, PLLC

(57) ABSTRACT

A device (10) for fastening a doctor blade (3) to a doctor blade (1) chamber body (2) comprising:
at least one clamping flange (11) configured to press the doctor blade (3) onto the doctor blade (1) chamber body (2),
at least a first fastener (20), and
at least one second fastener (30),
wherein the first fastener (20) comprises at least a first retaining section (21) having an upper end (21*a*) and a lower end (21*b*), a second section (22) different from the first retaining section (21), and
wherein the second fastener (30) comprises at least a first portion (31) having at least one retaining element (34*a*), a second portion (32) having at least one retain-
(Continued)

ing element (34*b*), an intermediate portion (33) devoid of retaining element and arranged between the first portion (31) and the second portion (32).

20 Claims, 3 Drawing Sheets

(56) References Cited

U.S. PATENT DOCUMENTS

| | | | | |
|---|---|---|---|---|
| 7,287,471 | B2 * | 10/2007 | Graeler | B41F 31/027 101/169 |
| 2007/0017394 | A1 | 1/2007 | Casitas et al. | |
| 2018/0178574 | A1 * | 6/2018 | Larsen | B41F 31/04 |

FOREIGN PATENT DOCUMENTS

| | | | |
|---|---|---|---|
| WO | 2005005148 | A1 | 1/2005 |
| WO | 2008152022 | A1 | 12/2008 |

* cited by examiner

DEVICE FOR ATTACHING A DOCTOR BLADE ON A DOCTOR BLADE CHAMBER AND DOCTOR BLADE CHAMBER THUS EQUIPPED

CROSS-REFERENCE TO RELATED APPLICATION(S)

This application is a National Stage under 35 U.S.C. § 371 of International Application No. PCT/EP2019/025130, filed on Apr. 26, 2019, which claims priority to French Patent Application No. 18/00384, filed on Apr. 30, 2018, the contents of all of which are incorporated by reference in their entirety.

This invention relates to the technical field of doctor blade chambers for rotary flexographic printing units and more particularly to the device for fastening the doctor blades to the body of doctor blade chambers.

Flexography is a rotary printing process that may be used on many supports, for example of the sheet or web type, in cardboard or plastic material, and requiring the use of plates, or printing forms, flexible and in relief. A printing machine comprises several printing units placed one after the other and each dedicated to a specific color. Flexography is a rotary printing process that may be used on many media and requires the use of plates, or printing forms, which are relatively flexible and in relief.

In flexography, a printing unit comprises a plate cylinder, configured to carry the printing plate, an anilox cylinder or anilox cylinder, having on its surface a set of cells intended to collect ink in a quantity controlled by the printer. volume of the cells, the anilox cylinder being configured to transfer the ink to the plate, a doctor blade chamber, configured to fill the cells of the anilox cylinder, a pump, ensuring the routing of the ink from the ink tank to the doctor blade chamber, and a counter-pressure cylinder holding the medium being printed against the plate cylinder.

STATE OF THE ART

Typically, each doctor blade in the doctor blade chamber is secured to the doctor blade chamber body by a fastening device comprising a clamping flange configured to press the doctor blade against a portion of the doctor blade chamber body and the fasteners. More precisely, the clamping flange is arranged to clamp and/or press and hold the doctor blade against the body and is screwed onto the doctor blade chamber body by screwing devices. The doctor blade is a long sharp blade which is dangerous to handle and requires a fastener applied along the entire length of a set of screwing devices to be fastened to the doctor blade chamber body. When installing a doctor blade, a first operator keeps the doctor blade in place under the flange while a second operator screws the screwing devices one by one. When replacing a doctor blade, operators must completely disassemble the flange by unscrewing all the screwing devices in order to release the doctor blade for replacement. These operations are tedious and time-consuming, all the more so since there is a risk of injury when handling the doctor blade, which is increased during maintenance since the operators must manage both the screws and the doctor blades.

Subject-Matter of the Invention

The subject-matter of this invention is to overcome all or part of the drawbacks described above so as to facilitate the handling of the doctor blades during their installation and their replacement, and thus to minimize the risk of injury to operators, by proposing a fastening device suitable for the doctor blade chamber doctor blades allowing the screws to be kept in place when replacing or installing the doctor blade on the doctor blade chamber body.

This invention relates to a device for fastening a doctor blade to a doctor blade chamber body comprising:

at least one clamping flange configured to press the doctor blade against the doctor blade chamber body, at least a first fastener, at least one second fastener, configured to cooperate with the first fastener, the flange being arranged between the first fastener and the second fastener.

The first fastener comprises at least a first retaining section having an upper end and a lower end, a second section different from the first retaining section, and The second fastener comprises at least a first portion having at least one retaining device, a second portion having at least one retaining device, an intermediate portion without a retaining device and arranged between the first portion and the second portion, the second fastener being movable in the first fastener between at least:

a first locking position in which the second portion works with the first retaining section of the first fastener, and the first portion is arranged in the second section, a second unlocking position in which the intermediate portion is positioned at the level of the first retaining section and is free to slide vis-à-vis the first retaining section along a longitudinal axis, between a first extreme position according to which the second portion abuts on the upper end of the first retaining section, and a second extreme position in which the first portion abuts on the lower end of the first retaining section.

Thanks to the fastening device according to the invention, the doctor blade may be put in place or changed without the fastening device being completely removed and then put back, which avoids the loss of fasteners and limits the number of times the doctor blade may be handled. Indeed, thanks to the release configuration, the second fastener is released and the flange is loosened. The flange may be kept attached to the doctor blade body, so that the doctor blade may be removed or inserted without having to remove the fastening device entirely. Thus, the operators attention is focused only on the doctor blade, which considerably decreases the risk of injury or poor positioning of the doctor blade on the doctor blade chamber body. Because of the simplified unlocking operations, there is no longer any need to have several operators to set up or change a doctor blade.

The first retaining section of the first fastener and the second portion may have at least one retaining element of the second fastener that work together in a form-fitting manner.

The first retaining section of the first fastener may be provided with a screw thread fashioned so as to work with a retaining element formed on the second portion of the second fastener and/or with a retaining element formed on the first portion of the second fastener.

The first fastener may be meant to be inserted directly or indirectly into an orifice provided on the doctor blade chamber body.

The first fastener may be an insert comprising an outer surface which is at least partially provided with a retaining element, preferably a screw thread meant to work with a third fastener. Thanks to the third fastener, the first fastener is inserted indirectly into an orifice provided on the doctor blade chamber body.

The first fastener may be of generally cylindrical shape.

The first retaining section of the first fastener and the second retaining section of the first fastener may be contiguous.

The first retaining section of the first fastener may have a width or diameter that is substantially less than the width or diameter of the second retaining section of the first fastener.

The first retaining section of the first fastener may have a height that is strictly lower than the height of the intermediate portion of the second fastener.

The first retaining section of the first fastener may have a height lower than or equal to the height of the second portion having at least one retaining element of the second fastener and/or at the height of the first portion having at least one retaining element of the second fastener.

The second fastener may be movable in a clamping position in which the second portion of the second fastener is entirely in the first retaining section and is preferably in abutment against the lower end of the first retaining section so that the clamp is pressed towards the body on the doctor blade. Advantageously, in the tightening position, the intermediate portion and the first portion of the second fastener are both arranged in the second section of the first fastener.

The retaining element of the first portion of the second fastener may be a screw thread complementary to the screw thread formed on the first retaining section of the first fastener.

The intermediate portion of the second fastener may be smooth.

Advantageously, the intermediate portion of the second fastener has a cross section substantially smaller than the cross section of the first portion and/or of the second portion.

The first portion having at least one retaining element of the second fastener may be separate and arranged at a distance from the second portion having at least one retaining element of the second fastener.

Advantageously, the height of the intermediate portion of the second fastener may be configured to define a free sliding distance of the second fastener in the first fastener.

The free sliding distance may be determined to correspond to a sufficient spacing from the flange relative to the doctor blade chamber body, so as to define a space for the extraction or insertion of the doctor blade.

The fastening device may comprise a set of first fasteners and a set of second fasteners, each first fastener working together with a second fastener.

The second fastener may comprise a first end on which is arranged the first portion having at least one retaining element.

The second fastener may include a second end equipped with a head.

The second portion having at least one retaining element of the second fastener may be arranged between the first end and the second end and preferably under the head of the second fastener.

The second end of the second fastener may include at least one gripping member.

The head of the second end may be equipped with a support portion meant to support and be centered upon a housing provided on the clamping flange.

The second fastener may be in the form of a double-threaded screw.

Advantageously, the second fastener can comprise a rod on which the first portion having at least one retainer, the second portion having at least one retainer and the intermediate portion are arranged.

The fastening device may include a third fastener comprising an internal cavity configured to at least partially house the first fastener.

The first fastener may comprise an outer surface upon which is provided, at least partially, a working component configured to combine forces with a complementary element formed in the internal cavity of the third fastener.

The third fastener may have a flared support portion intended to support the internal surface of the doctor blade chamber body.

The third fastener may further comprise an upper end forming a collar projecting from the outer surface of the doctor blade chamber body and serving as a stop for the doctor blade.

The third fastener may include a lower end designed to extend into the doctor blade chamber body and configured to at least partially accommodate the first fastener.

The internal cavity may be a through orifice or a blind orifice, formed at least up to the lower end of the third fastener.

The third fastener may be of generally cylindrical shape.

The clamping flange may comprise a housing fashioned so as to receive a support portion of the head of the second end of the second fastener.

The subject-matter of the invention is also a doctor blade chamber comprising at least one elongated body extending along a longitudinal axis and comprising a first portion upon which a first doctor blade is fastened by at least one fastening device according to the invention.

The body may comprise at least a second portion to which a second doctor blade is fastened by at least one second fastening device according to the invention, the second doctor blade being arranged opposite the first doctor blade relative to the longitudinal axis of the body.

The first portion of the body may be equipped with a set of orifices each designed to accommodate the insertion of at least one first fastener or at least one third fastener.

The second portion of the body may be equipped with a set of orifices each designed to accommodate the insertion of at least one first fastener or at least one third fastener.

The third fixing member may be crimped into the orifice made on the doctor blade chamber body.

BRIEF DESCRIPTION OF THE FIGURES

The invention will be better understood, thanks to the description, which relates to an embodiment according to the present invention, given by way of non-limiting example and explained with reference to the appended figures, in which the signs of identical numerical references correspond to elements that are structurally and/or functionally identical or similar. The appended figures are listed below.

DETAILED DESCRIPTION

Figure 1:
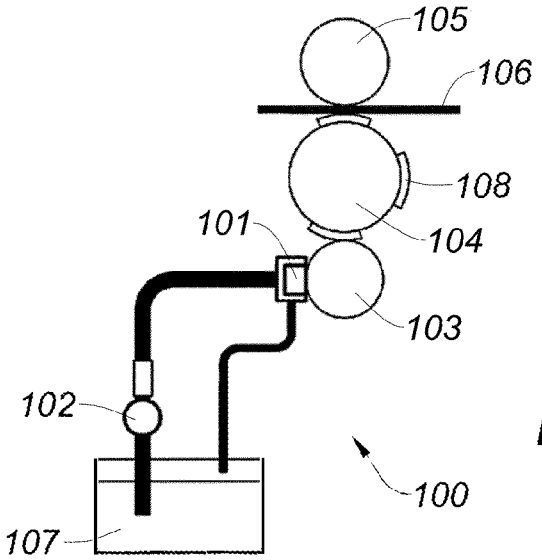
FIG. 1 is a diagram illustrating a printing unit structure.

As illustrated in FIG. 1, a printing unit 100 comprises a plate cylinder 104 configured to support a plate or printing form 108, an anilox cylinder or anilox cylinder 103, having on its surface a set of cells intended to collect ink in quantity controlled by the volume of the cells, the anilox cylinder 103 being configured to transfer the ink to the plate 108, a doctor blade chamber 101, configured to fill the cells of the anilox cylinder 103, a pump 102 ensuring the routing of the ink from the ink reservoir 107 to the doctor blade chamber 101, and a back pressure cylinder 105 holding the support 106 during printing against the plate cylinder 104, and thus against the plate 108.

The doctor blade chamber 1 according to the invention comprises an elongated body 2 extending along a longitudinal axis X-X and comprising a first portion 2*a* configured to receive a first doctor blade 3. The body 2 further comprises a second portion 2*b* configured to receive a second doctor blade 3 (see FIGS. 2 and 3). Furthermore, the body 2 comprises a third portion 2*c* connecting the first portion 2*a* and the second portion 2*b*, a cavity 2*e* intended to receive the ink and delimited at least by the first portion 2*a*, the second portion 2*b* and the third portion 2*c*. Advantageously, each doctor blade 3 is held on the doctor blade 1 chamber body 2 by a fastening device 10 according to the invention (FIGS. 4 to 9). In the example illustrated in FIG. 2, the doctor blade chamber 1 is equipped with two fastening devices 10.

Figure 3:
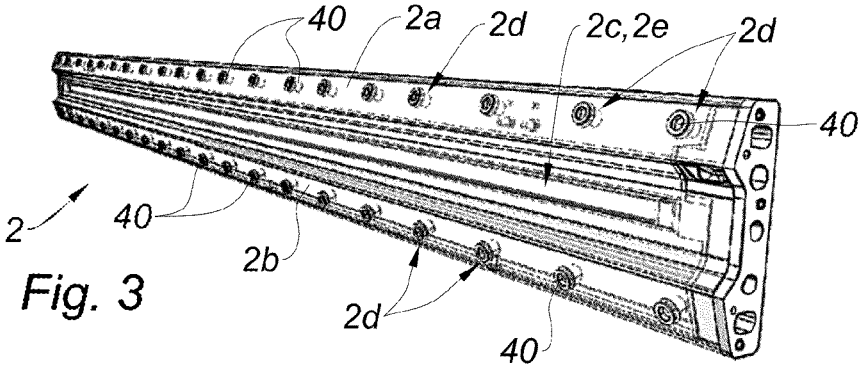
FIG. 3 is a partial perspective view of the doctor blade chamber illustrated in FIG. 2, equipped with the third fastener of the fastening device according to the invention.

The doctor blade 1 chamber body 2 comprises a set of orifices 2*d* extending along the first portion 2*a* and along the second portion 2*b* of the body 2 (FIG. 3). The orifices 2*d* are regularly spaced along each portion 2*a*, 2*b* of the body 2. Each orifice 2*d* is fashioned so as to receive an insert corresponding to the third fastener 40 of the fastening device 10 in a preferred and illustrated embodiment. In a unshown variant, each orifice 2*d* is fashioned so as to receive an insert corresponding to the first fastener 20.

According to the invention, the fastening device 10 comprises a clamping flange 11 configured to press the doctor blade 3 onto the body 2 of the doctor blade chamber 1 (FIGS. 4 to 9). Advantageously, the clamping flange 11 can be of the same length as the doctor blade 3 or a different (shorter) length. In the case where the clamping flange 11 is of shorter length than the doctor blade 3, the fastening device 10 can comprise several clamping flanges 11 placed end to end so as to cover the length of the doctor blade 3.

Figure 5:
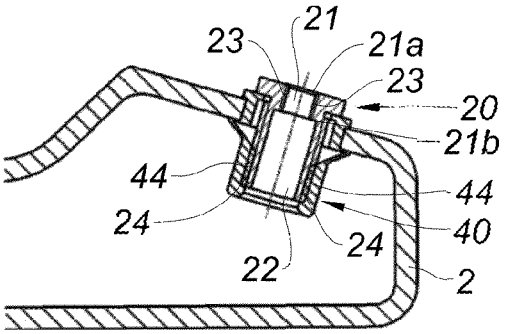
FIG. 5 is a sectional view illustrating the first fastener mounted in the third fastener according to the invention.
Figure 6:
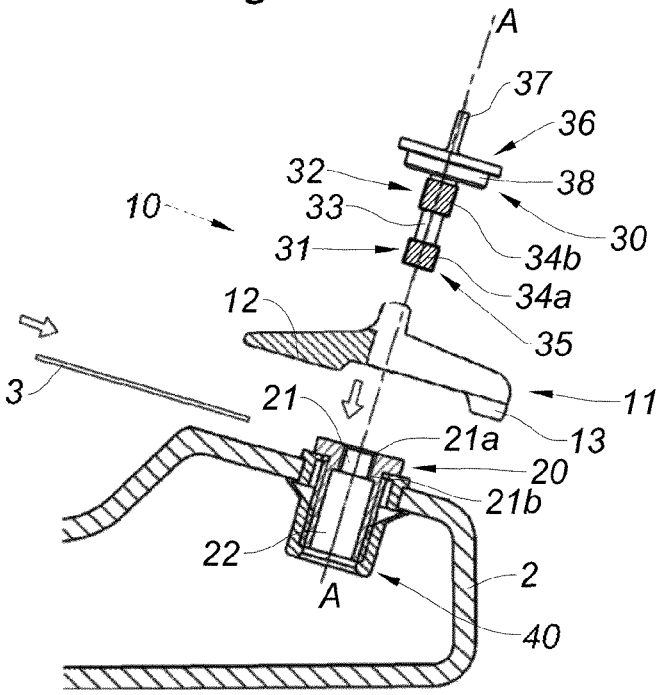
FIG. 6 is an exploded sectional view illustrating the fastening device according to the invention.

The fastening device 10 comprises a first fastener 20, a second fastener 30 and a third fastener 40 (see FIG. 6). It should be noted that FIGS. 2 to 9 illustrate the preferred embodiment of the invention in which the fastening device 10 comprises a third fastener 40 which could be considered as optional according to the invention. The flange 11 is arranged between the first fastener 20 and the second fastener 30.

Figure 4:
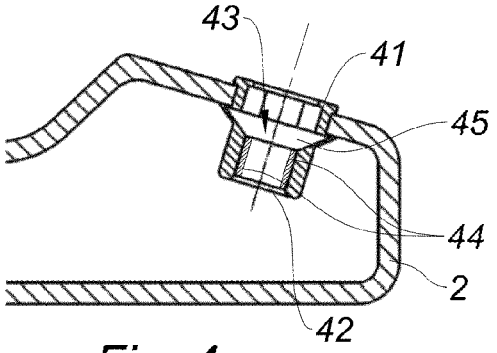
FIG. 4 is a sectional view illustrating the third fastener of the fastening device according to the invention.

The third fastener 40 is generally cylindrical in shape (FIG. 4). As can be seen in FIG. 4 in particular, the third fastener 40 comprises an internal cavity 43 configured to at least partially house the first fastener 20, visible in particular in FIG. 5. The third fastener 40 comprises an upper end 41 meant to be flush with the body 2 of the doctor blade chamber 1 and a lower end 42 meant to extend into the body 2 of the doctor blade chamber 1 and configured to at least partially house the first fastener 20. Advantageously, the internal cavity 43 is a through orifice or a blind orifice, provided at least up to the lower end 42 of the third fastener 40. The internal cavity 43 is equipped (see FIG. 4) with a complementary working component 44, in the form of a screw thread for example, and designed to work with a retaining device 24 (visible in FIG. 5). provided on the outer surface of the first fastener 20. Furthermore, the third fastener 40 comprises a flared portion 45 arranged between the upper end 41 and the lower end 42 of the third fastener 40. According to the invention, the flared portion 45 is a support portion designed to support the internal surface of the body 2 of the doctor blade chamber 1.

The first fastener 20 is generally cylindrical in shape (FIG. 5). The first fastener 20 comprises at least a first retaining section 21 having an upper end 21*a* and a lower end 21*b* and a second section 22 different from the first retaining section 21. The first retaining section 21 and the second section 22 are contiguous. The first retaining section 21 has a width or a diameter that is substantially smaller than the width or the diameter of the second section 22. The first retaining section 21 is provided with a retainer 23, preferably a screw thread meant to work with a retainer 34*b* provided on the second fastener 30. In addition, the first fastener 20 comprises an outer surface upon which is at least partially provided a retainer 24 in the form of a screw thread complementary to that 44 formed in the third fastener 40.

The second fastener 30 is configured to work with the first fastener 20 (FIG. 6). The second fastener 30 comprises at least a first portion 31 having at least one retainer 34*a*, a second portion 32 having at least one retainer 34*b*, an intermediate portion 33 devoid of a retainer and arranged between the first portion 31 and the second portion 32.

Figure 8:
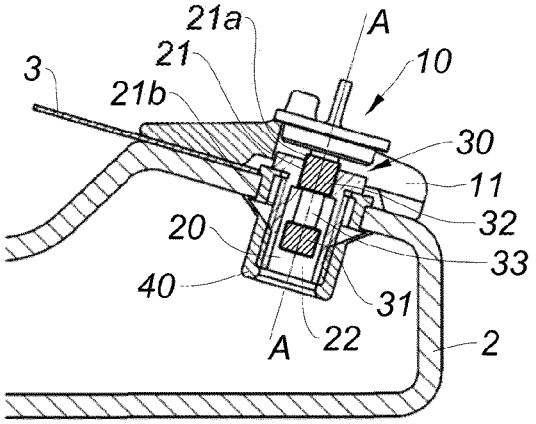
FIG. 8 is a sectional view illustrating the fastening device according to the invention in the locking configuration.
Figure 9:
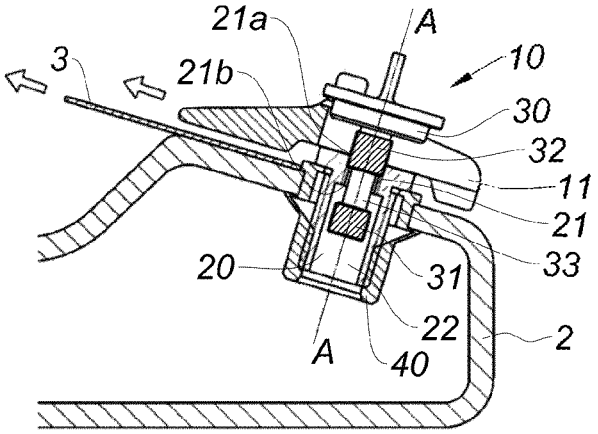
FIG. 9 is a sectional view illustrating the fastening device according to the invention in the intermediate unlocking configuration.

According to the invention, the second fastener 30 is movable in the first fastener 20 between at least a first locking position and an unlocking position (FIG. 8).

The locking position consists of the second portion 32 cooperating with the first retaining section 21 of the first fastener 20, and the first portion 31 is arranged in the second section 22.

Figure 7:
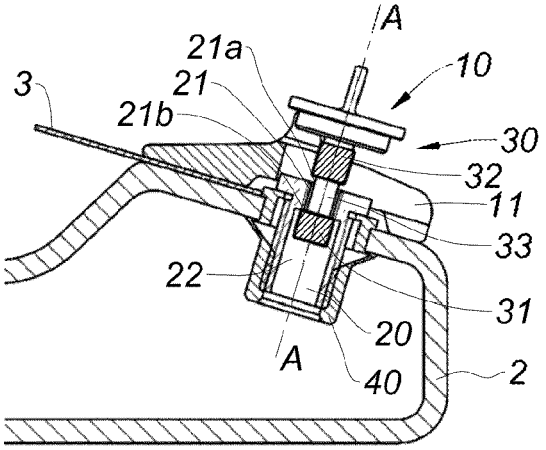
FIG. 7 is a sectional view illustrating the fastening device according to the invention in the unlocking configuration.

The unlocking position consists in that the intermediate portion 33 is positioned at the level of the first retaining section 21 and is free to slide vis-à-vis the first retaining section 21 along a longitudinal axis A-A, between an extreme first position according to which the second portion 32 of the second fastener 30 abuts the upper end 21*a* of the first retaining section 21, and a second extreme position according to which the first portion 31 of the second fastener 30 abuts the lower end 21*b* of the first retaining section 21 (FIG. 7). In the first extreme position, the first portion 31 of the second fastener 30 is arranged in the second section of the first fastener 20. In the second extreme position, the second portion 32 of the second fastener 30 is outside, that is to say, completely disengaged, from the first fastener 20.

Advantageously, the first retaining section 21 has a height that is strictly lower than the height of the intermediate portion 33, which allows free sliding from one extreme position to another. In addition, the first retaining section 21 has a height less than or equal to the height of the second portion 32 and/or to the height of the first portion 31. In addition, the height of the intermediate portion 33 is configured to define a free sliding distance of the second fastener 30 in the first fastener 20, the free sliding distance being determined to correspond to a sufficient spacing from the flange relative to the doctor blade chamber body, so as to define an extraction or insertion space for the doctor blade (see FIG. 9).

Furthermore, the second fastener 30 may also be in a clamping position in which the second portion 32 of the second fastener 30 is entirely in the first retaining section 21 and is preferably in abutment against the lower end 21*b* of the first retaining section 21 so that the flange 11 is pressed towards the body on the doctor blade (FIG. 8). In the clamping position, the intermediate portion 33 and the first portion 31 of the second fastener 30 are both arranged in the second section 22 of the first fastener 20.

In addition, the second fastener 30 can also be in an intermediate unlocking position, in which the intermediate portion 33 is not free to slide and the second portion 32 is partially engaged in the first retaining section 21.

Finally, another intermediate position is possible in particular during the complete assembly or disassembly of the fastening device, and in which the first portion 31 of the second fastener 30 can be partially or fully engaged in the first retaining section 21.

According to the invention, the retainer 34*a* of the first portion 31 is a complementary thread of the screw thread 23 formed on the first retaining section 21 (FIG. 6). In addition, the retainer 34*b* of the second portion 32 is a complementary thread of the screw thread 23 provided on the first retaining section 21. In addition, the intermediate portion 33 is smooth.

The second fastener 30 comprises a first end 35 upon which is arranged the first portion 31 and a second end 36 equipped with a head, the second portion 32 being arranged between the first end 35 and the second end 36 and preferably under the head of the second fastener 30 (FIG. 6).

Preferably, the second end 36 of the second fastener 30 comprises at least one gripping member 37. In addition, the head of the second end 36 is equipped with a support portion 38 meant to support a housing (not shown) provided on the clamping flange 11.

Advantageously, the second fastener 30 is in the form of a double-threaded screw, comprising a rod upon which the first portion 31, the second portion 32 and the intermediate portion 33 are arranged.

Figure 2:
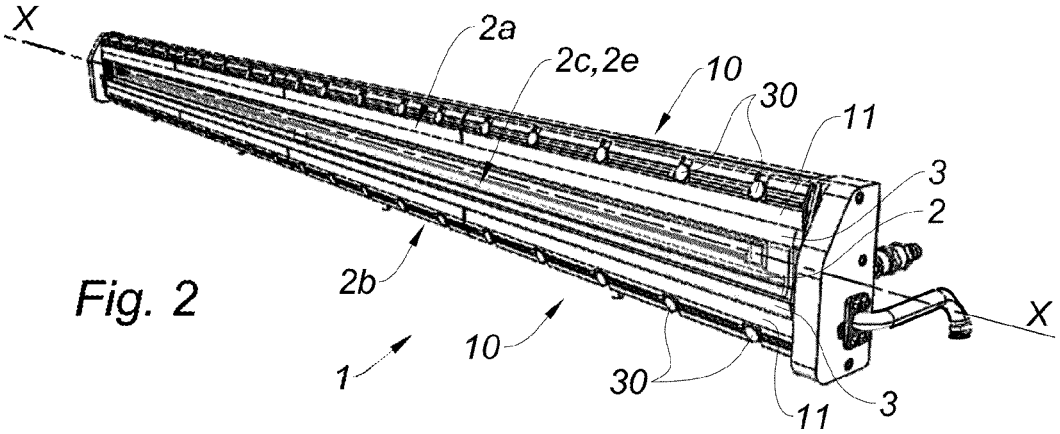
FIG. 2 is a view in perspective of a doctor blade chamber according to the invention.

Each fastening device 10 comprises a set of first fasteners 20, a set of second fasteners 30, each first fastener 20 working together with a second fastener 30 (FIG. 2).

The clamping flange 11 comprises a clamping portion 12 designed to be in contact with and to support the doctor blade 3 (FIG. 6). The clamping flange 11 further comprises a support portion 13 opposite to the clamping portion 12 and configured to support the doctor blade 1 chamber body 2. In addition, the clamping flange 11 comprises a housing (not shown) fashioned so as to receive the support portion 38 of the head of the second end 36 of the second fastener 30.

The first event to take place in the order in which the assembly of the fastening device 10 occurs, a third fastener 40 (FIG. 4) is inserted into each orifice 2*d* of the doctor blade 1 chamber body 2. Preferably, the third fastener 40 is crimped onto the body 2.

Next, the first fastener 20 is inserted into the third fastener 40 (FIG. 5). The first fastener 20 is preferably screwed into the third fastener 40.

Then, the clamping flange 11 is positioned on the doctor blade 1 chamber body 2, and the second fastener 30 is inserted through the clamping flange 11 in the first fastener 20, by screwing the first portion 31 of the second fastener 30 until the first portion 31 of the second fastener 30 is in the second section 22 of the first fastener 20 and the second fastener 30 is in the unlocking position (FIG. 7). Once in the unlocking position, the doctor blade 3 can easily be inserted into the space between the clamping portion 12 of the flange and the body 2 by moving the second fastener and the clamping flange 11, along the longitudinal sliding axis A-A.

The invention is not limited to the embodiments described and shown in the appended figures. Modifications remain possible, in particular from the point of view of the constitution of the various elements or by substitution of technical equivalents, without thereby departing from the scope of protection of the invention.

The invention claimed is:

1. A device for fastening a doctor blade on a doctor blade chamber body comprising:

a clamping flange configured to press the doctor blade onto the doctor blade chamber body, and a plurality of fastening assemblies configured to fasten the clamping flange to the doctor blade, each fastening assembly comprising:

a first fastener, and a second fastener configured to work with the first fastener, at least a portion of the clamping flange being arranged between at least a portion of the first fastener and at least a portion of the second fastener, wherein the first fastener comprises a first retaining section having an upper end and a lower end, and a second section different from the first retaining section, and wherein the second fastener comprises a first portion having a first retaining element, a second portion having a second retaining element, and an intermediate portion without a retaining element and arranged between the first portion and the second portion, the second fastener being movable in the first fastener between at least:

a first locking position in which the second portion works with the first retaining section of the first fastener, and the first portion is arranged in the second section, a second unlocking position in which the intermediate portion is positioned at the level of the first retaining section and is free to slide vis-à-vis the first retaining section according to a longitudinal axis, between a first extreme position according to which the second portion abuts the upper end of the first retaining section, and a second extreme position according to which the first portion abuts the lower end of the first retaining section.

2. The device of claim 1, wherein the first retaining section of the first fastener and the second portion of the second fastener work together in a form-fitting manner.

3. The device of claim 1, wherein the first retaining section is provided with a screw thread fashioned so as to work with the second retaining element provided on the second portion of the second fastener and/or with the first retaining element provided on the first portion of the second fastener.

4. The device of claim 1, wherein the first retaining section has a length less than a length of the intermediate portion, the lengths of the first retaining section and the intermediate portion extending in a direction parallel to the longitudinal axis.

5. The device of claim 4, wherein the length of the intermediate portion is configured to define a free sliding distance of the second fastener in the first fastener.

6. The device of claim 1, wherein the fastening assembly comprises a third fastener comprising an internal cavity configured to at least partially house the first fastener.

7. A doctor blade chamber comprising an elongated body extending along a longitudinal axis and comprising a first portion on which a first doctor blade is fixed by the device as claimed in claim 6, wherein the first portion of the elongated body is equipped with a set of orifices, each orifice designed to accommodate the insertion of the third fastener.

8. A doctor blade chamber comprising an elongated body extending along a longitudinal axis and comprising a first portion on which a first doctor blade is fixed by the device as claimed in claim 1.

9. The doctor blade chamber of claim 8, wherein the first portion of the elongated body is equipped with a set of orifices, each orifice designed to accommodate the insertion of the first fastener.

10. The device of claim 1, wherein the second fastener has a head provided at a first side of the clamping flange in the first locking position.

11. A fastening assembly configured to fasten at least a portion of a clamping flange to a portion of a doctor blade, the clamping flange being configured to press the portion of the doctor blade onto a doctor blade chamber body, wherein the fastening assembly comprises:

a first fastener including a first retaining section having an upper end and a lower end, and a second fastener configured to work with the first fastener to fasten the portion of the clamping flange to the doctor blade, the second fastener including a first portion having a first retaining element, a second portion having a second retaining element, and an intermediate portion without a retaining element and arranged between the first portion and the second portion, wherein an arrangement of the first and second fasteners is configured such that at least a portion of the clamping flange is configured to be received between at least a portion of the first fastener and at least a portion of the second fastener, and wherein the second fastener is movable in the first fastener between at least:

a first locking position in which the second portion works with the first retaining section of the first fastener, and the first portion is arranged in the second section, and a second unlocking position in which the intermediate portion is positioned at the level of the first retaining section and is free to slide vis-à-vis the first retaining section according to a longitudinal axis, between a first extreme position according to which the second portion abuts the upper end of the first retaining section, and a second extreme position according to which the first portion abuts the lower end of the first retaining section.

12. The fastening assembly of claim 11, wherein the first retaining section of the first fastener and the second portion of the second fastener work together in a form-fitting manner.

13. The fastening assembly of claim 11, wherein the first retaining section is provided with a screw thread fashioned so as to work with the second retaining element provided on the second portion of the second fastener and/or with the first retaining element provided on the first portion of the second fastener.

14. The fastening assembly of claim 11, wherein:

the first retaining section has a length less than a length of the intermediate portion, the lengths of the first retaining section and the intermediate portion extending in a direction parallel to the longitudinal axis; and the length of the intermediate portion is configured to define a free sliding distance of the second fastener in the first fastener.

15. The fastening assembly of claim 11, further comprising a third fastener comprising an internal cavity configured to at least partially house the first fastener.

16. A device for fastening a doctor blade on a doctor blade chamber body comprising:

a clamping flange; and a plurality of fastening assemblies according to claim 11.

17. A doctor blade chamber comprising an elongated body extending along a longitudinal axis and comprising a first portion on which a first doctor blade is fixed by a first device, the first device including a clamping flange and a plurality of fastening assemblies according to claim 11.

18. The doctor blade chamber of claim 17, wherein the first portion of the elongated body is equipped with a plurality of orifices corresponding to the plurality of fastening assemblies such that each orifice is designed to accommodate the insertion of one fastening assembly.

19. The doctor blade chamber of claim 17, wherein the at least one elongated body comprises a second portion on which a second doctor blade is fixed by a second device, the second doctor blade being arranged opposite the first doctor blade relative to the longitudinal axis of the elongated body, and the second device including a clamping flange and a plurality of fastening assemblies according to claim 11.

20. The doctor blade chamber of claim 17, wherein the second fastener has a head provided at the second side of the clamping flange in the first locking position.

* * * * *